US011268678B2

(12) United States Patent
Li et al.

(10) Patent No.: US 11,268,678 B2
(45) Date of Patent: Mar. 8, 2022

(54) WATERPROOF STAGE LAMP STRUCTURE EASY TO DISASSEMBLE AND MAINTAIN AND WATERPROOF STAGE LAMP

(71) Applicant: FLY DRAGON LIGHTING EQUIPMENT CO., LTD, Guangzhou (CN)

(72) Inventors: Xiaobin Li, Guangzhou (CN); Gaoliang Li, Guangzhou (CN); Xiaomei Zhang, Guangzhou (CN)

(73) Assignee: FLY DRAGON LIGHHING EQUIPMENT CO., LTD, Guangzhou (CN)

( * ) Notice: Subject to any disclaimer, the term of this patent is extended or adjusted under 35 U.S.C. 154(b) by 0 days.

(21) Appl. No.: 17/084,675

(22) Filed: Oct. 30, 2020

(65) Prior Publication Data

US 2021/0071849 A1 Mar. 11, 2021

Related U.S. Application Data

(63) Continuation of application No. PCT/CN2019/083029, filed on Apr. 17, 2019.

(30) Foreign Application Priority Data

Mar. 21, 2019 (CN) ..... 201910216774.0

(51) Int. Cl.
*F21V 17/12* (2006.01)
*F21V 29/67* (2015.01)
(Continued)

(52) U.S. Cl.
CPC ..... *F21V 17/12* (2013.01); *F21V 15/01* (2013.01); *F21V 17/16* (2013.01); *F21V 29/67* (2015.01);
(Continued)

(58) Field of Classification Search
CPC ..... F21V 17/12; F21V 29/67; F21V 15/01; F21V 17/16; F21V 31/005; F21V 29/767;
(Continued)

(56) References Cited

U.S. PATENT DOCUMENTS 7,633,756 B2 * 12/2009 Xu ..... H01L 23/427 165/104.33
7,985,005 B2 * 7/2011 Alexander ..... F21V 29/70 362/294
(Continued)

FOREIGN PATENT DOCUMENTS

CN 205402414 U 7/2016
CN 206093746 U 4/2017
(Continued)

OTHER PUBLICATIONS

International Search Report issued in corresponding International application No. PCT/CN2019/083029, dated Dec. 12, 2019 (6 pages).
(Continued)

*Primary Examiner* — Tsion Tumebo

(57) ABSTRACT

A waterproof stage lamp structure easy to disassemble and maintain and a waterproof stage lamp include an upper shell, a lower shell, a waterproof heat-conducting plate, an anti-loosening connecting piece, a main functional module, a front-end functional module, a heat dissipation module and guide positioning rods disposed on the waterproof heat-conducting plate. The main functional module and the heat dissipation module are matched with the guide positioning rods respectively, so that center axes of the center light holes of each module are concentric. A power supply of each module is closely connected to a signal interface and the lamp is internally quickly installed and maintained, and the
(Continued)

power supply is automatically docked with or separated from the signal interface during installation or disassembly.

13 Claims, 8 Drawing Sheets

(51) Int. Cl.
*F21V 15/01* (2006.01)
*F21V 17/16* (2006.01)
*F21V 31/00* (2006.01)
*F21W 131/406* (2006.01)

(52) U.S. Cl.
CPC ..... *F21V 31/005* (2013.01); *F21W 2131/406* (2013.01)

(58) Field of Classification Search
CPC ..... F21V 31/00; F21V 29/56; F21V 17/162; F21W 2131/406; F21W 2131/105; F21S 8/00
See application file for complete search history.

(56) References Cited

U.S. PATENT DOCUMENTS 8,884,501 B2 * 11/2014 Cho ..... F21V 3/04 313/46
9,109,788 B2 * 8/2015 Dalsgaard ..... F21V 21/30
10,400,966 B2 * 9/2019 Chang ..... F21V 5/04
10,753,594 B2 * 8/2020 Jiang ..... F21V 29/67
10,962,215 B2 * 3/2021 Jiang ..... F21V 29/763
2008/0062692 A1 * 3/2008 Andersen ..... F21V 29/75 362/275
2010/0060132 A1 * 3/2010 Liu ..... F21V 29/67 313/46
2013/0201689 A1 * 8/2013 Dalsgaard ..... F21V 29/505 362/294
2017/0123131 A1 * 5/2017 Root ..... F21V 29/89
2019/0137090 A1 * 5/2019 Jiang ..... F21V 17/10
2020/0173725 A1 * 6/2020 Jiang ..... F28D 1/0408

FOREIGN PATENT DOCUMENTS

CN 108278582 A 7/2018
CN 208566349 U 3/2019

OTHER PUBLICATIONS

Written Opinion of the International Searching Authority for No. PCT/CN2019/083029.

* cited by examiner

WATERPROOF STAGE LAMP STRUCTURE EASY TO DISASSEMBLE AND MAINTAIN AND WATERPROOF STAGE LAMP

CROSS REFERENCE OF RELATED APPLICATIONS

The present application is a continuation-application of International (PCT) Patent Application No. PCT/CN2019/083029, titled "WATERPROOF STAGE LAMP STRUCTURE CONVENIENT FOR DISASSEMBLY, ASSEMBLY AND MAINTENANCE, AND WATERPROOF STAGE LAMP", filed on Apr. 17, 2019, which claims foreign priority of Chinese Patent Application No. 201910216774.0, titled "WATERPROOF STAGE LAMP STRUCTURE CONVENIENT FOR DISASSEMBLY, ASSEMBLY AND MAINTENANCE, AND WATERPROOF STAGE LAMP", filed on Mar. 21, 2019, the entire contents of which are hereby incorporated by reference.

TECHNICAL FIELD

The present invention relates to the technical field of stage lamp equipment, and in particular, to a waterproof stage lamp structure easy to disassemble and maintain and a waterproof stage lamp.

BACKGROUND

At present, the shell of a stage lamp in the market is usually integrally formed, and then a light source is installed in the shell, so that the stage lamp is easy to disassemble. The lamp with the integrally formed shell has better waterproof performance. However, for a stage lamp with a detachable structure in the market, because the internal structure of the lamp is modularized in a grouped mode, it is impossible to ensure that the lamp is internally quickly installed and maintained while a power supply of each module is closely connected to a signal interface, and it is also impossible to ensure that center axes of center light holes of different modules in the lamp are concentric and the power supply is automatically docked with or separated from the signal interface while the modules are installed or disassembled.

SUMMARY

To overcome the disadvantages of the prior art, a first objective of the present invention is to provide a waterproof stage lamp structure easy to disassemble and maintain. The structure can ensure that the lamp is internally quickly installed and maintained while a power supply of each module is closely connected to a signal interface, and can also ensure that center axes of center light holes of different modules in the lamp are concentric and the power supply is automatically docked with or separated from the signal interface while the modules are installed or disassembled.

A second objective of the present invention is to provide a waterproof stage lamp. The lamp can ensure that the lamp is internally quickly installed and maintained while a power supply of each module is closely connected to a signal interface, and can also ensure that center axes of center light holes of different modules in the lamp are concentric and the power supply is automatically docked with or separated from the signal interface while the modules are installed or disassembled.

The first objective of the present invention is implemented by using the following technical solution:

A waterproof stage lamp structure easy to disassemble and maintain, including an upper shell, a lower shell, a waterproof heat-conducting plate and an anti-loosening connecting piece, where the waterproof heat-conducting plate is disposed between the upper shell and the lower shell, and the upper shell, the waterproof heat-conducting plate and the lower shell are detachably connected through the anti-loosening connecting piece;

the waterproof stage lamp structure further includes a lens assembly, the lens assembly includes a shell and a lens, the shell is detachably connected to the upper shell and provided with a light outlet, and the lens is disposed at the light outlet;

the waterproof stage lamp structure further includes a main functional module, a front-end functional module, a heat dissipation module and a light source assembly, a sealed chamber is formed between the upper shell and the waterproof heat-conducting plate, the main functional module is located in the sealed chamber and disposed on the waterproof heat-conducting plate, a lens sealing chamber is formed in the shell, the front-end functional module is located in the lens sealing chamber, a heat dissipation chamber is formed between the lower shell and the waterproof heat-conducting plate, the heat dissipation module passes through the waterproof heat-conducting plate and is positioned by the waterproof heat-conducting plate; a lower portion of the heat dissipation module is received in the heat dissipation chamber, the main functional module is in electrical signal connection with the front-end functional module and the heat dissipation module respectively through docking pieces, the light source assembly is disposed on the main functional module, and a light beam generated by the light source assembly passes through a center light hole of each module and then is projected to the outside through the light outlet; and the waterproof stage lamp structure further includes guide positioning rods disposed on the waterproof heat-conducting plate, and the main functional module and the heat dissipation module are matched with the guide positioning rods respectively, so that center axes of the center light holes of each module are concentric.

Further, the upper shell, the waterproof heat-conducting plate and the lower shell are in threaded connection through the anti-loosening connecting piece.

Further, the anti-loosening connecting piece includes anti-loosening screws, mounting through-holes are formed between the upper shell, the waterproof heat-conducting plate and the lower shell, and the anti-loosening screws are inserted in the mounting through-holes and connected to the mounting through-holes through threads.

Further, the anti-loosening connecting piece further includes an anti-loosening spring, and the anti-loosening spring sleeves the anti-loosening screw and abuts against the lower shell.

Further, the guide positioning rods are parallel to the center axes of the center light holes of each module.

Further, there are a plurality of guide positioning rods, and any two of the guide positioning rods are parallel to each other.

Further, the docking piece includes a pair of connectors matched with each other.

Further, the connectors are VGA connectors.

The second objective of the present invention is implemented by using the following technical solution.

A waterproof stage lamp, including the foregoing waterproof stage lamp structure easy to disassemble and maintain.

Compared with the prior art, the present invention has the following beneficial effects.

The present invention is mainly used to implement the grouped modularization of the internal structure of the waterproof stage lamp when a shell is fully sealed, and ensure that a lamp body is internally quickly installed and maintained while a power supply of each module is closely connected to a signal interface. A main functional module and a heat dissipation module can be installed on or disassembled from the lamp in a front-rear mode by matching with guide positioning rods. This ensures that center axes of center light holes of different modules in the lamp are concentric and the power supply is automatically docked with or separated from the signal interface while the modules are installed or disassembled.

Figure 1:
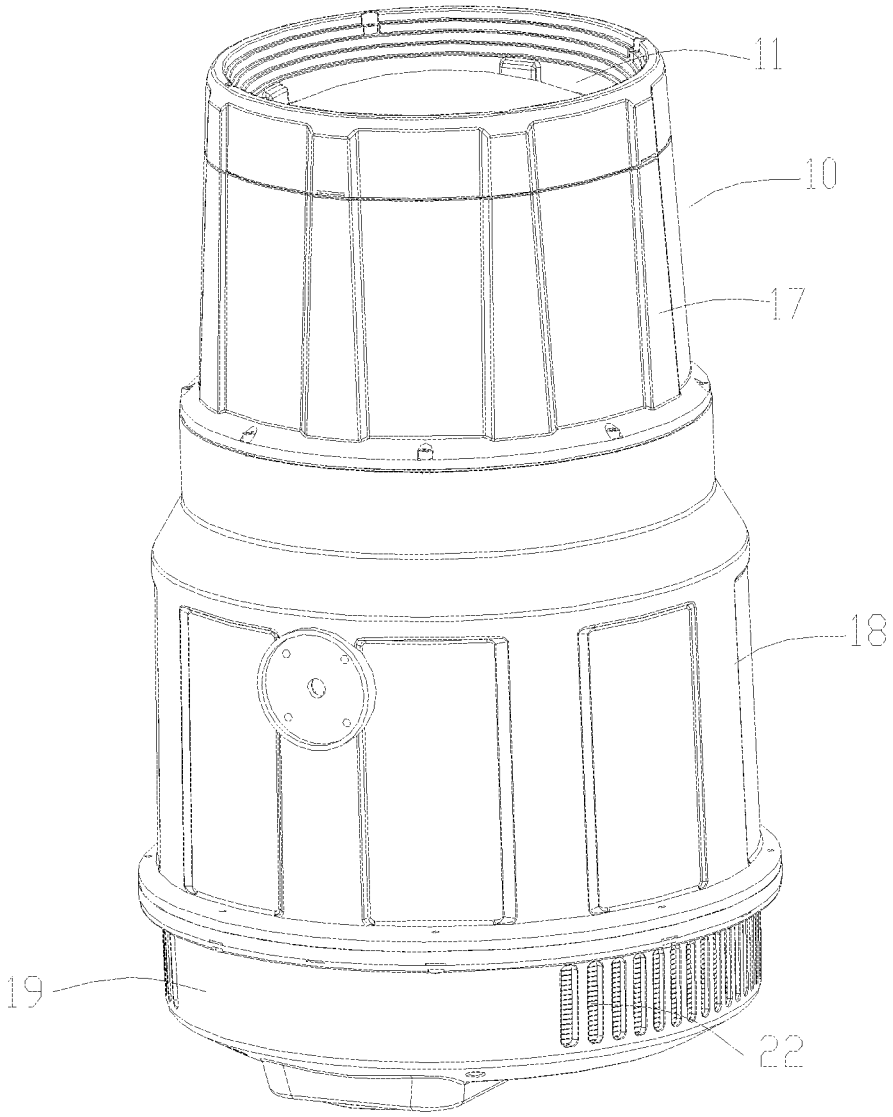
FIG. 1 is a schematic structural diagram according to the present invention.

Reference numerals in the figures: 10. lens assembly; 11. lens; 12. positioning block; 13. front-end functional module; 14. main functional module; 15. heat dissipation module; 16. waterproof heat-conducting plate; 17. shell; 18. upper shell; 19. lower shell; 20. guide positioning rod; 21. anti-loosening screw; 22. heat dissipation through-hole; 23. docking piece; 24. heat dissipation assembly; 25. heat dissipation groove; 26. installation groove; 27. cooling fan; 28. light source assembly; 29. condensing tube; 30. rear-end waterproof fan set; 31. power signal transfer board; 32. connector.

DESCRIPTION OF EMBODIMENTS

The present invention will be further described below with reference to the accompanying drawings and specific embodiments. It should be noted that all embodiments described below or all the technical features can be arbitrarily combined to form new embodiments, provided that no conflict occurs.

Figure 2:
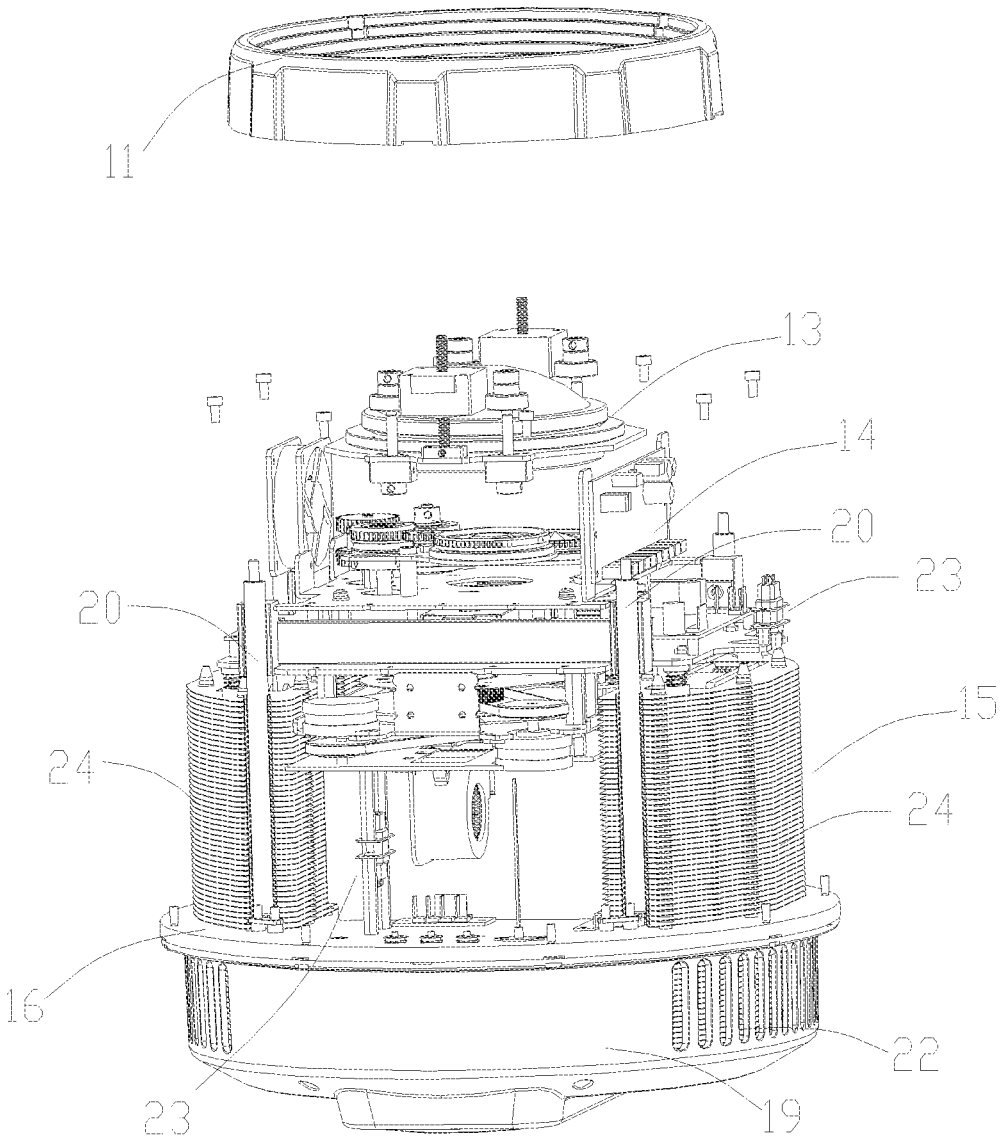
FIG. 2 is a schematic diagram of an internal structure of a sealed chamber according to the present invention.
Figure 3:
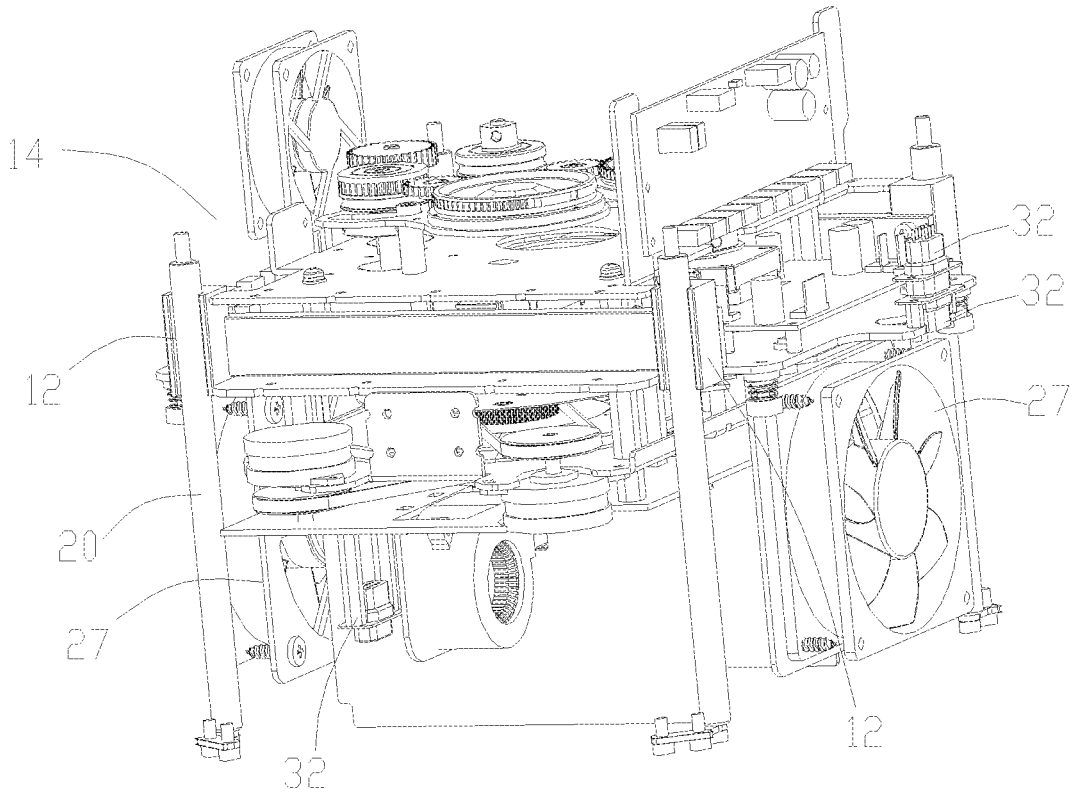
FIG. 3 is a schematic structural diagram of a main functional module according to the present invention.
Figure 4:
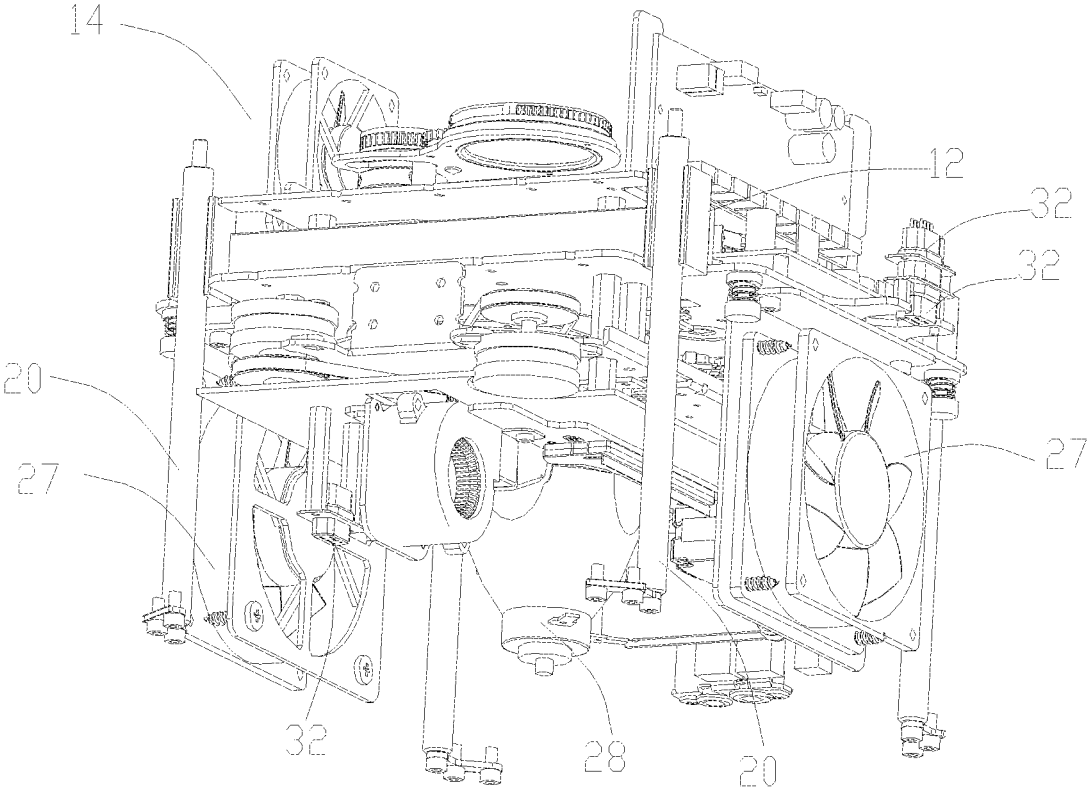
FIG. 4 is a schematic structural diagram of a light source assembly according to the present invention.
Figure 5:
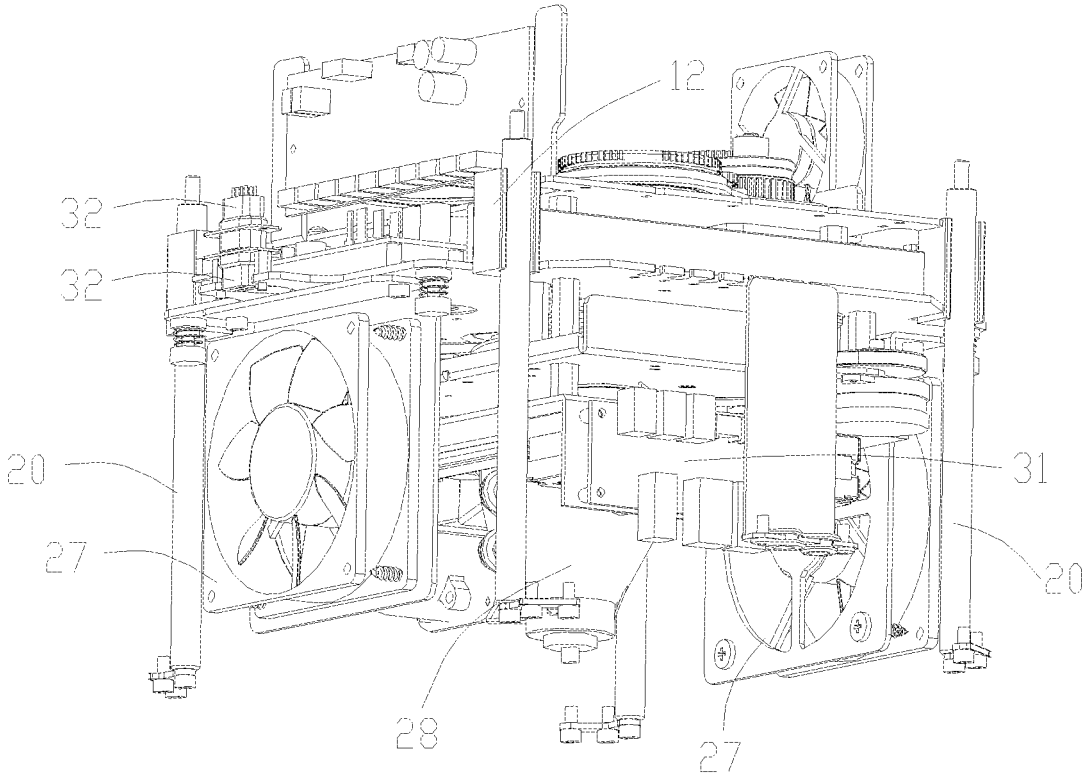
FIG. 5 is a schematic structural diagram of a power signal transfer board according to the present invention.
Figure 6:
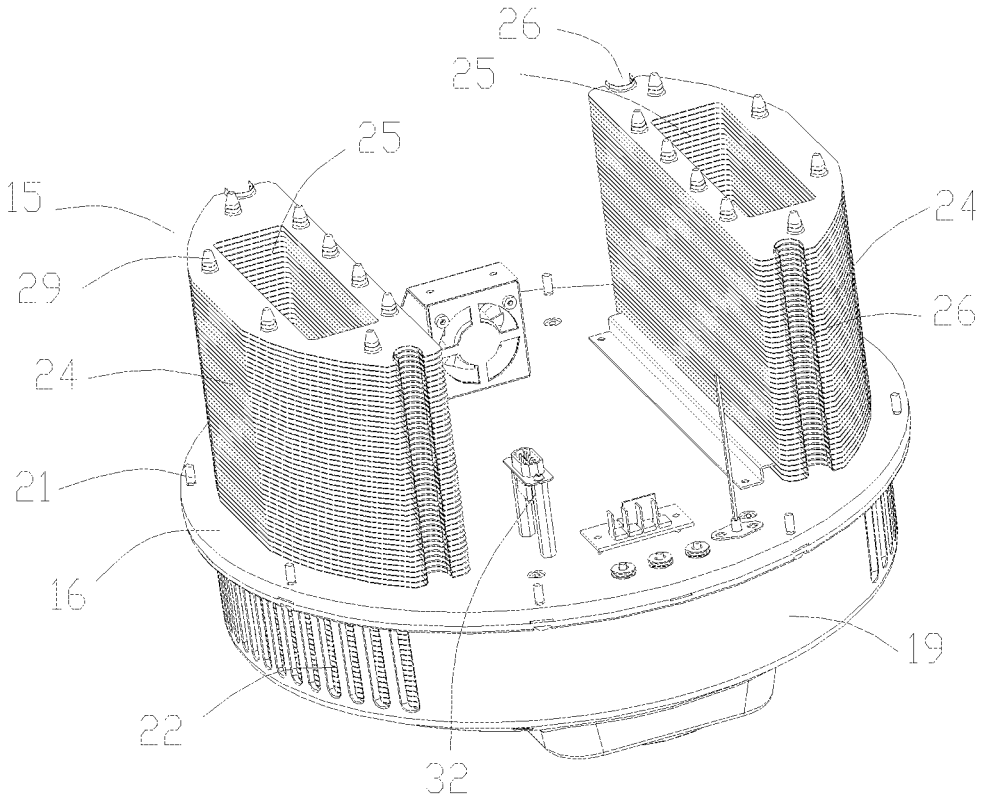
FIG. 6 is a schematic structural diagram of a heat dissipation module according to the present invention.
Figure 7:
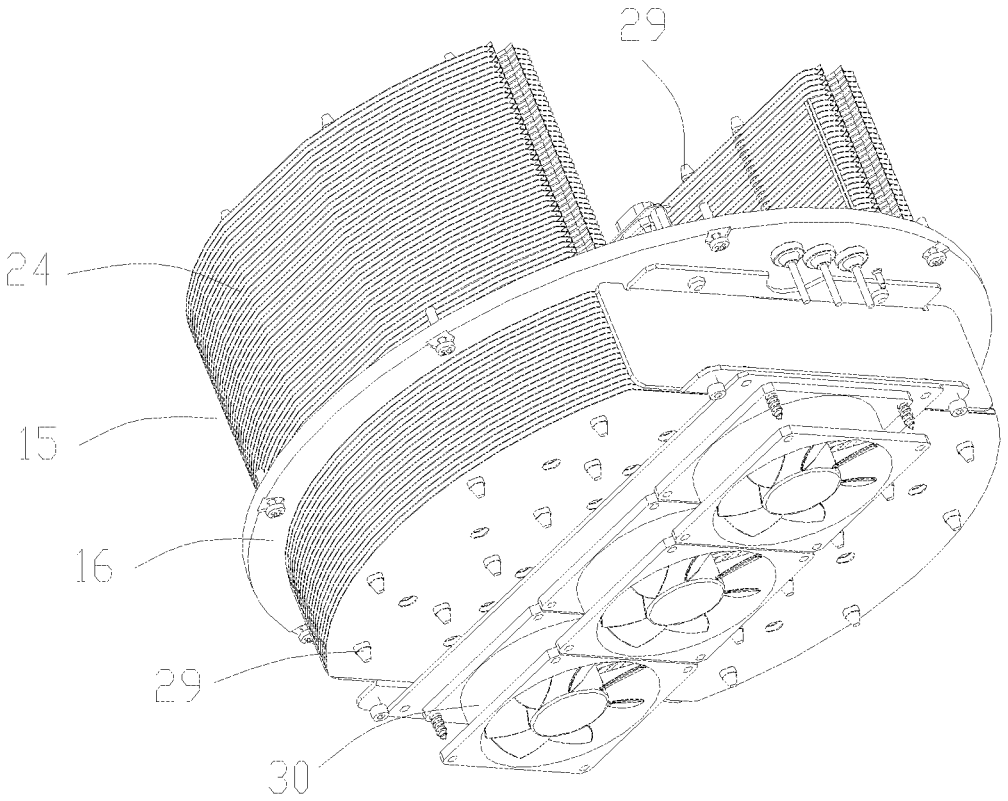
FIG. 7 is a schematic structural diagram of a rear-end waterproof fan set according to the present invention.
Figure 8:
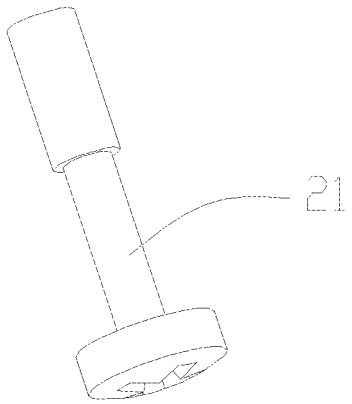
FIG. 8 is a schematic structural diagram of an anti-loosening screw according to the present invention.

A waterproof stage lamp structure easy to disassemble and maintain shown in FIG. 1 to FIG. 8 includes an upper shell 18, a lower shell 19, a waterproof heat-conducting plate 16 and an anti-loosening connecting piece, where the waterproof heat-conducting plate 16 is disposed between the upper shell 18 and the lower shell 19, and the upper shell 18, the waterproof heat-conducting plate 16 and the lower shell 19 are detachably connected through the anti-loosening connecting piece.

the waterproof stage lamp structure further includes a lens assembly 10, the lens assembly 10 includes a shell 17 and a lens 11, the shell 17 is detachably connected to the upper shell 18 and provided with a light outlet, and the lens 11 is disposed at the light outlet; and the waterproof stage lamp structure further includes a main functional module 14, a front-end functional module 13, a heat dissipation module 15 and a light source assembly 28, a sealed chamber is formed between the upper shell 18 and the waterproof heat-conducting plate 16, the main functional module 14 is located in the sealed chamber and disposed on the waterproof heat-conducting plate 16, a lens 11 sealing chamber is formed in the shell 17, and the front-end functional module 13 is located in the lens 11 sealing chamber. The sealed chamber and the lens 11 sealing chamber formed internally have good sealing effects and improve the waterproof effect. A heat dissipation chamber is formed between the lower shell 19 and the waterproof heat-conducting plate 16, the heat dissipation module 15 passes through the waterproof heat-conducting plate 16 and is positioned by the waterproof heat-conducting plate 16. A lower portion of the heat dissipation module 15 is received in the heat dissipation chamber; the main functional module 14 is in electrical signal connection with the front-end functional module 13 and the heat dissipation module 15 respectively through docking pieces 23, the light source assembly 28 is disposed on the main functional module 14, and a light beam generated by the light source assembly 28 passes through a center light hole of each module and then is projected to the outside through the light outlet; and the waterproof stage lamp structure further includes guide positioning rods 20 disposed on the waterproof heat-conducting plate 16, and the main functional module 14 and the heat dissipation module 15 are matched with the guide positioning rods 20 respectively, so that center axes of the center light holes of each module are concentric.

Preferably, the heat dissipation module 15 in this embodiment includes two heat dissipation assemblies 24. The two heat dissipation assemblies 24 are matched with the guide positioning rods 20 respectively, such that the two heat dissipation assemblies 24 are connected with the waterproof heat-conducting plate 16. Each of the heat dissipation assemblies 24 is provided with a heat dissipation groove 25, and a cooling fan 27 is disposed in the heat dissipation groove 25. Each of the heat dissipation assemblies 24 includes a plurality of cooling fins, and a gap channel is formed between the adjacent cooling fins. A blade rotation plane of the cooling fan 27 is perpendicular to the gap channel. When the cooling fan 27 is started, since the blade rotation plane of the cooling fan 27 is perpendicular to the gap channel, heat generated by the light source assembly 28 can well flow through the gap channel, so that the heat dissipation efficiency is improved.

In this embodiment, heat dissipation through-holes 22 are formed on the rear-end side of the lower shell 19, so that the heat generated by the light source assembly 28 can be dissipated to the outside through the heat dissipation through-holes 22.

In addition, since the lower shell 19 is disposed on the other side of the waterproof heat-conducting plate 16, the heat dissipation module 15 passes through the waterproof heat-conducting plate 16 and positioned by the waterproof heat-conducting plate 16. This can well prevent external water vapor from entering the sealed chamber.

In addition, the heat dissipation module 15 may further include a plurality of condensing tubes 29. The plurality of condensing tubes 29 sequentially pass through the cooling fins and the waterproof heat-conducting plate 16, so that the heat generated by the light source assembly 28 passes through the cooling fins and the waterproof heat-conducting plate 16 and is dissipated to the outside.

The heat dissipation module 15 may further include a rear-end waterproof fan set 30, and the rear-end waterproof fan set 30 is disposed on the other side of the waterproof heat-conducting plate 16. When a power supply is switched on so that the rear-end waterproof fan set 30 is started, the rear-end waterproof fan set 30 brings in outside cold air from the tail of the light source assembly 28 (i.e., the lower shell 19), and then quickly discharges the outside cold air from the heat dissipation through-hole 22 on the rear-end side of the lower shell 19. Wind baffles on both sides (formed on both sides of the lower shell 19) can guide the cold air so as to dissipate the heat generated by the light source assembly 28 to the outside, thus ensuring rapid heat dissipation.

In a preferred implementation of this embodiment, the upper shell 18, the waterproof heat-conducting plate 16 and the lower shell 19 are in threaded connection through the anti-loosening connecting piece.

Specifically, the anti-loosening connecting piece includes anti-loosening screws 21, mounting through-holes are formed between the upper shell 18, the waterproof heat-conducting plate 16 and the lower shell 19, and the anti-loosening screws 21 are inserted in the mounting through-holes and connected to the mounting through-holes through threads.

In a preferable embodiment, the anti-loosening connecting piece further includes an anti-loosening spring, and the anti-loosening spring sleeves the anti-loosening screw 21. An end of the anti-loosening spring abuts against an outer wall of the lower shell 19. The anti-loosening screw 21 can be quickly loosened through the anti-loosening spring and can be prevented from falling off, so as to avoid the separation of the upper shell 18, the waterproof heat-conducting plate 16 and the lower shell 19 from each other. This improves the overall assembly stability of the structure. It should be noted that a rear end of a screw rod of the anti-loosening screw 21 is threadless and the outer diameter is reduced to ensure that the screw can be loosened without falling off.

It should be noted that the guide positioning rod 20 is parallel to the center axes of the center light holes of each module. This enables each module to be better assembled on the waterproof heat-conducting plate 16.

It should be noted that there are a plurality of guide positioning rods 20, and any two of the guide positioning rods 20 are parallel to each other.

Preferably, there are four guide positioning rods 20 in this embodiment. Both sides of each heat dissipation assembly 24 are provided with installation grooves 26 respectively, and the installation grooves 26 are matched with the guide positioning rods 20. The main functional module 14 is provided with a positioning block 12, and the positioning block 12 is provided with a positioning groove. The positioning groove is matched with the guide positioning rod 20, which is beneficial to making the center axes of the center light holes of each module concentric.

The main functional module 14 includes a power signal transfer board 31. A lamp power signal bus can be separately connected to each functional module in the power signal transfer board 31, so as to supply power for each functional module.

Specifically, the docking piece 23 includes a pair of connectors 32 matched with each other.

It should be emphasized that the connector 32 of this embodiment is preferably a VGA connector 32. Therefore, the power supply of each module can be automatically docked with or separated from the signal interface.

In this embodiment, there are two docking pieces 23: a first docking piece 23 and a second docking piece 23 respectively. A pair of connectors 32 in the first docking piece 23 are disposed on the main functional module 14 and the heat dissipation module 15 respectively, so as to implement power signal docking with the heat dissipation module 15, so that the main functional module 14 and the heat dissipation module 15 can implement automatic docking and separation between the power supply and the signal interface. A pair of connectors 32 in the second docking piece 23 are disposed on the main functional module 14 and the front-end functional module 13 respectively, so as to implement power signal docking with the front-end functional module 13, so that the main functional module 14 and the front-end functional module 13 can implement automatic docking and separation between the power supply and the signal interface.

This embodiment further discloses a waterproof stage lamp including the foregoing waterproof stage lamp structure easy to disassemble and maintain.

This embodiment is mainly used to implement the grouped modularization of the internal structure of the waterproof stage lamp when a shell is fully sealed, and ensure that a lamp body is internally quickly installed and maintained while a power supply of each module is closely connected to a signal interface. A main functional module 14 and a heat dissipation module 15 can be installed on or disassembled from the lamp in a front-rear mode by matching with guide positioning rods 20. This ensures that center axes of center light holes of different modules in the lamp are concentric and the power supply is automatically docked with or separated from the signal interface while the modules are installed or disassembled.

The foregoing embodiments are only the preferred embodiments of the present invention, and cannot be used to limit the protection scope of the present invention. Any immaterial changes and replacements made by those skilled in the art on the basis of the present invention fall within the protection scope claimed by the present invention.

What is claimed is:

1. A waterproof stage lamp structure easy to disassemble and maintain, comprising an upper shell, a lower shell, a waterproof heat-conducting plate and an anti-loosening connecting piece, wherein the waterproof heat-conducting plate is disposed between the upper shell and the lower shell, and the upper shell, the waterproof heat-conducting plate and the lower shell are detachably connected through the anti-loosening connecting piece;

the waterproof stage lamp structure further comprises a lens assembly, the lens assembly comprises a shell and a lens, the shell is detachably connected to the upper shell and provided with a light outlet, and the lens is disposed at the light outlet;

the waterproof stage lamp structure further comprises a main functional module, a front-end functional module, a heat dissipation module and a light source assembly, a sealed chamber is formed between the upper shell and the waterproof heat-conducting plate, the main functional module is located in the sealed chamber and disposed on the waterproof heat-conducting plate, a lens sealing chamber is formed in the shell, the front-end functional module is located in the lens sealing chamber, a heat dissipation chamber is formed between the lower shell and the waterproof heat-conducting plate, the heat dissipation module passes through the waterproof heat-conducting plate and is positioned by the waterproof heat-conducting plate; a lower portion of the heat dissipation module is received in the heat dissipation chamber; the main functional module is in electrical signal connection with the front-end functional module and the heat dissipation module respectively through docking pieces, the light source assembly is disposed on the main functional module, and a light beam generated by the light source assembly passes through a center light hole of each module and then is projected to the outside through the light outlet; and the waterproof stage lamp structure further comprises guide positioning rods disposed on the waterproof heat-conducting plate, wherein the heat dissipation module comprises two heat dissipation assemblies that are symmetrically arranged; two sides of each of the two heat dissipation assemblies comprises installation grooves; the main functional module comprises positioning blocks; each of the positioning blocks is provided with a positioning groove; when assembled, each of the guide positioning rods is inserted into and received in a corresponding installation groove and a corresponding positioning groove to position the main functional module and make center axes of the center light holes of each module concentric; the docking pieces are automatically connected with or separated from each other by sliding the guide and positioning rods.

2. The waterproof stage lamp structure easy to disassemble and maintain according to claim 1, wherein the upper shell, the waterproof heat-conducting plate and the lower shell are in threaded connection through the anti-loosening connecting piece.

3. The waterproof stage lamp structure easy to disassemble and maintain according to claim 2, wherein the anti-loosening connecting piece comprises anti-loosening screws, mounting through-holes are formed between the upper shell, the waterproof heat-conducting plate and the lower shell, and the anti-loosening screws are inserted in the mounting through-holes and connected to the mounting through-holes through threads.

4. The waterproof stage lamp structure easy to disassemble and maintain according to claim 3, wherein the anti-loosening connecting piece further comprises an anti-loosening spring, and the anti-loosening spring sleeves the anti-loosening screw and abuts against the lower shell.

5. The waterproof stage lamp structure easy to disassemble and maintain according to claim 1, wherein the guide positioning rods are parallel to the center axes of the center light holes of each module.

6. The waterproof stage lamp structure easy to disassemble and maintain according to claim 1, wherein there are a plurality of guide positioning rods, and any two of the guide positioning rods are parallel to each other.

7. The waterproof stage lamp structure easy to disassemble and maintain according to claim 5, wherein there are a plurality of guide positioning rods, and any two of the guide positioning rods are parallel to each other.

8. The waterproof stage lamp structure easy to disassemble and maintain according to claim 1, wherein the docking piece comprises a pair of connectors matched with each other.

9. The waterproof stage lamp structure easy to disassemble and maintain according to claim 8, wherein the connectors are VGA connectors.

10. A waterproof stage lamp, comprising the waterproof stage lamp structure easy to disassemble and maintain according to claim 1.

11. The waterproof stage lamp structure easy to disassemble and maintain according to claim 1, wherein the heat dissipation module further comprises a plurality of condensing tubes; the plurality of condensing tubes pass through the heat dissipation module and the waterproof heat-conducting plate to dissipate heat generated by the light source assembly to an outside.

12. The waterproof stage lamp structure easy to disassemble and maintain according to claim 1, wherein each of the heat dissipation assemblies is provided with a heat dissipation groove, and a cooling fan is disposed in each heat dissipation groove; each of the heat dissipation assemblies comprises a plurality of cooling fins; a gap channel is formed between each two adjacent cooling fins; a blade rotation plane of each cooling fan is perpendicular to each gap channel.

13. The waterproof stage lamp structure easy to disassemble and maintain according to claim 1, the heat dissipation module comprises a rear-end waterproof fan set; the rear-end waterproof fan set is disposed on the waterproof heat-conducting plate; the rear-end waterproof fan set is configured to brings in outside cold air from a tail of the light source assembly and quickly discharge the heat from a heat dissipation through-hole on a rear-end side of the lower shell.

* * * * *